US009045268B2

(12) United States Patent
Pelfrey

(10) Patent No.: US 9,045,268 B2
(45) Date of Patent: Jun. 2, 2015

(54) COLLAPSIBLE CONTAINER AND DISPENSER EMPLOYING A COLLAPSIBLE CONTAINER

(75) Inventor: Keith A. Pelfrey, Wadsworth, OH (US)

(73) Assignee: GOJO Industries, Inc., Akron, OH (US)

( * ) Notice: Subject to any disclaimer, the term of this patent is extended or adjusted under 35 U.S.C. 154(b) by 27 days.

(21) Appl. No.: 13/557,792

(22) Filed: Jul. 25, 2012

(65) Prior Publication Data

US 2014/0027470 A1 Jan. 30, 2014

(51) Int. Cl.

| | |
|---|---|
| ***B65D 35/56*** | (2006.01) |
| ***B65D 75/52*** | (2006.01) |
| ***B65D 21/08*** | (2006.01) |
| *A47K 5/12* | (2006.01) |

(52) U.S. Cl.

CPC ..... *B65D 75/525* (2013.01); *B65D 21/086* (2013.01); *A47K 5/12* (2013.01)

(58) Field of Classification Search

USPC ..... 222/105, 107, 92, 209, 386.5, 389, 222/181.2, 181.3, 154, 156, 23, 41, 95, 326

See application file for complete search history.

(56) References Cited

U.S. PATENT DOCUMENTS

| | | | | | |
|---|---|---|---|---|---|
| 393,899 | A | * | 12/1888 | Haines | 206/524.4 |
| 2,099,595 | A | * | 11/1937 | Brown | 222/105 |
| 3,494,513 | A | * | 2/1970 | Bauer | 222/386.5 |
| 3,595,441 | A | * | 7/1971 | Grosjean | 222/107 |
| 4,349,133 | A | * | 9/1982 | Christine | 222/183 |
| 5,083,678 | A | * | 1/1992 | Waring | 222/92 |
| 5,190,190 | A | * | 3/1993 | Fudalla | 222/105 |
| 5,207,355 | A | | 5/1993 | Thomsen | |
| 5,248,066 | A | | 9/1993 | Olson et al. | |
| 5,445,288 | A | | 8/1995 | Banks | |
| 5,556,005 | A | | 9/1996 | Banks | |
| 5,611,461 | A | * | 3/1997 | Kubota et al. | 222/105 |
| 5,638,989 | A | * | 6/1997 | Ophardt et al. | 222/105 |
| 5,731,021 | A | * | 3/1998 | Spector | 426/111 |
| D433,938 | S | | 11/2000 | Polan | |
| 6,158,620 | A | * | 12/2000 | Polan | 222/92 |
| 6,390,332 | B2 | * | 5/2002 | Wakayama | 222/105 |
| 6,619,505 | B1 | * | 9/2003 | Decottignies et al. | 222/95 |
| 6,877,642 | B1 | | 4/2005 | Maddox et al. | |
| 6,945,428 | B2 | * | 9/2005 | Shimizu et al. | 222/105 |

(Continued)

FOREIGN PATENT DOCUMENTS

| | | | |
|---|---|---|---|
| DE | 202008008742 | U1 | 6/2009 |
| EP | 0581724 | A1 | 2/1994 |

(Continued)

*Primary Examiner* — J. Casimer Jacyna
*Assistant Examiner* — Benjamin R Shaw
(74) *Attorney, Agent, or Firm* — Renner Kenner Greive Bobak Taylor & Weber

(57) ABSTRACT

A collapsible container has a front face and a collapsible backing, wherein the container volume decreases as product is removed, and the collapsible backing collapses by vacuum as the container volume decreases. The front face may be flexible and thus susceptible to losing its original shape as the container volume decreases, but is nevertheless designed to retain its shape by having a frame around at least a portion of its perimeter. The front face may instead be adapted to retain its shape as the collapsible backing collapses upon a decrease in the container volume. The collapsible container is of particular beneficial use in a dispenser housing having a sight window in a front wall thereof, the sight window being aligned with the front face of the collapsible container.

10 Claims, 6 Drawing Sheets

(56) References Cited

U.S. PATENT DOCUMENTS

| | | | | |
|---|---|---|---|---|
| 7,028,861 | B2 * | 4/2006 | Sayers et al. | 222/1 |
| 7,086,568 | B1 * | 8/2006 | Cheek | 222/103 |
| 7,357,267 | B1 | 4/2008 | Shimada et al. | |
| 2004/0069800 | A1 * | 4/2004 | Piccinino et al. | 222/105 |
| 2006/0144855 | A1 * | 7/2006 | Von Schuckmann | 222/95 |
| 2008/0237263 | A1 | 10/2008 | Green et al. | |
| 2009/0114679 | A1 * | 5/2009 | Ophardt et al. | 222/105 |
| 2010/0252573 | A1 * | 10/2010 | Hetmaniok et al. | 222/105 |

FOREIGN PATENT DOCUMENTS

| | | | |
|---|---|---|---|
| GB | 2260746 | A | 4/1993 |
| JP | H066215 | U | 1/1994 |
| JP | 53063335 | U | 12/2013 |

* cited by examiner

COLLAPSIBLE CONTAINER AND DISPENSER EMPLOYING A COLLAPSIBLE CONTAINER

FIELD OF THE INVENTION

The present invention generally relates to collapsible containers. In particular embodiments, the present invention relates to a collapsible container for use in a liquid dispenser. In a specific embodiment the present invention generally relates to a collapsible container useful in a dispenser wherein a pump communicates with the collapsible container and the container collapses as product is removed from the container by operation of the pump. The invention is useful for dispensing any flowable product and finds popular usage in dispensing soaps and sanitizers.

BACKGROUND OF THE INVENTION

Collapsible containers are well known and used in a variety of environments. The collapsible container disclosed herein will be useful in any environment wherein it is desired that a container collapse as product is removed from the container. However, when disclosing aspects of the collapsible container herein, the liquid dispensing arts are focused upon. Notably, in particular embodiments, the present application focuses upon collapsible containers employed in liquid dispensers that most commonly dispense hand-treatment products such as soaps, hand sanitizers, and lotions. Nevertheless, it should again be stressed that the collapsible containers herein can be employed in a multitude of environments because the containers taught herein collapse upon the removal of product, regardless of the particular product therein or the particular environment in which they are employed.

Collapsible containers for liquid dispensers range in complexity from simple film-type plastic bags, such as those in the well-known bag-in-a-box type dispensers (e.g. U.S. Pat. No. 5,598,952), to more rigid yet collapsible structures such as that shown U.S. Pat. No. 5,083,678. The containers are sealed such that the removal of product from the container causes the container volume to decrease by the volume of the product removed. Typically, a pump is sealed to the container, and the actuation of the pump causes product to be removed from the container. In such environments, the collapsing of the container presents a number of advantages.

First, when the available product is dispensed from the container, the container is fully collapsed and thus takes up less space in any rubbish bin and landfill. Second, when the inlet to the pump is positioned within the volume of the container, the collapsing of the container can result in a more efficient evacuation of the container volume, as the collapsing of the container will force product within the container toward the pump inlet. In particular embodiments, such as in U.S. Pat. No. 5,083,678, the collapsing of the container can also serve to urge product in the container toward a sight window in a dispenser housing so that the depletion of the product within the container can be more readily monitored through that sight windows. The use of sight windows in dispenser housings, particularly wall-mounted dispensers for hand-treatment products, is well known. Finally, by providing containers that collapse in a predictable manner, it is possible to ensure that the container does not change shape in such a manner that it bulges, kinks or twists within the dispenser and undesirably contacts the internal structures of the dispenser housing. When containers bulge, kink or twist in this manner they can undesirably place stresses on the structures of the dispenser housing. This can lead to an improper seating of the container in the dispenser and may also cause the elements actuating the pump to work harder, thus increasing the power requirements of the dispenser.

Some prior art provides for more controlled collapsing of containers through the use of fold lines formed in the container walls. Such include U.S. Pat. Nos. 5,445,288 and 5,556,005, wherein fold lines are provided so as to create container that collapses to form an I-beam structure. Regardless of the implementation of the fold lines, these structures still bulge, kink and twist to some extent. Additionally, the bulging, kinking and twisting of the container can draw the container away from the aforementioned sight windows, thus obscuring the view of the level of product left in the container.

Prior art collapsible container are also commonly blow molded or otherwise formed as an completed but empty container, and these empty containers are stored until sales of product make it advisable to fill those empty containers to fill product orders. Thus, large storage space must be devoted to empty containers, and this is undesirable.

While the prior art does provide for different types of collapsible containers, the focus on complicated structures with fold lines and other features for urging product to lie close to a sight window is misplaced. The present invention substantially improves the art by simplifying the collapsible container while improving its functionality, particularly with respect to urging product toward a sight window of a dispenser. Also, the prior art can be improved upon by avoiding the need to store voluminous empty containers until it is necessary to fill them.

SUMMARY OF THE INVENTION

A first embodiment of this invention provides a collapsible container for receipt in a dispenser housing that provides means for the dispensing of product from the collapsible container, the collapsible container comprising: a front face having a perimeter; a frame defined around at least a portion of said perimeter of said front face adapted to engage the dispenser housing to retain the front face in position in the housing; a collapsible backing secured to said front face to define a container volume; and product retained within said container volume, wherein the container volume is sealed such that the removal of a portion of said product from said container volume causes said container volume to decrease, and, as said container volume decreases, said collapsible backing collapses by vacuum toward said front face.

In a second embodiment, this invention provides a container as in the first embodiment above, wherein said front face is made of a flexible film.

In a third embodiment, this invention provides a container as in either the first or second embodiment above, wherein said frame includes a plurality of frame supports.

In a fourth embodiment, this invention provides a container as any of the first through third embodiments above, wherein said plurality of frame supports are apertures.

In a fifth embodiment, this invention provides a container as any of the first through fourth embodiments above, wherein said collapsible backing is made of a flexible film.

In a sixth embodiment, this invention provides a container as any of the first through fifth embodiments above, wherein said front face is adapted to retain its shape as said collapsible backing collapses as said container volume decreases upon the removal of product from the container.

In a seventh embodiment, this invention provides a container as any of the first through sixth embodiments above, wherein said collapsible backing is made of a flexible film.

In an eighth embodiment, this invention provides a container as any of the first through seventh embodiments above, wherein said collapsible backing includes fold lines and said collapsible backing collapses along said fold lines as said container volume decreases.

In a ninth embodiment, this invention provides a container as any of the first through eighth embodiments above, wherein said collapsible backing includes: a rear wall opposite said front face; right and left side walls interconnecting said front face and said rear wall; a bottom wall interconnecting with said front face, rear wall, right side wall and left side wall; a top wall interconnecting with said front face, rear wall, right side wall and left side wall, said front face, rear wall, right side wall, left side wall, top wall and bottom wall defining a container volume holding product; a rear wall upper fold line extending across said rear wall, said rear wall upper fold line separating said rear wall into an upper facet between said rear wall upper fold line and said top wall and a central facet between said rear wall upper fold line and said bottom wall, wherein the removal of product from said container causes said container volume to decrease, and, as said container volume decreases, said container folds along said rear wall upper fold line such that said upper facet folds down toward said central facet and said front wall is devoid of a fold line that mimics the structure and function of said rear wall upper fold line such that the folding at said rear wall upper fold line is not simulated at said front wall and said front wall retains its shape.

In a tenth embodiment, this invention provides a container as any of the first through ninth embodiments above, wherein, as additional portions of said product are removed from said container volume and the container approaches the empty configuration, at least a portion of said collapsible backing comes into close proximity to said front face.

In an eleventh embodiment, this invention provides a container as any of the first through tenth embodiments above, wherein at least a portion of said front face is transparent or translucent.

In a twelfth embodiment, this invention provides a container as any of the first through eleventh embodiments above, wherein said collapsible backing has an interior surface, and indicia is provided on said interior surface such that said indicia is visible through said transparent or translucent portion of said front face when said interior surface approaches near or contacts said front face.

In a thirteenth embodiment, this invention provides a container as any of the first through twelfth embodiments above, wherein said indicia provides notice that the container is nearly empty.

In a fourteenth embodiment, this invention provides a container as any of the first through thirteenth embodiments above, wherein said front face is formed of a material that resists puncturing.

In a fifteenth embodiment, this invention provides a container as any of the first through fourteenth embodiments above, further comprising a pump that is actuated to dispense a dose of said product from said container.

In a sixteenth embodiment, this invention provides a container collapsible from a filled configuration to an empty configuration during dispensing of the contents therein, the container comprising: a front face; a collapsible backing secured to said front face to define a container volume; and product retained within said container volume, wherein the container volume is sealed such that the removal of a portion of said product from said container volume causes said container volume to decrease, and, as said container volume decreases, said collapsible backing collapses by vacuum toward said front face, said front face being adapted to retain its shape as said collapsible backing collapses upon the removal of product from the container.

In a seventeenth embodiment, this invention provides a container as in the sixteenth embodiment above, wherein said front face has a perimeter and the container further comprises a frame defined around at least a portion of the perimeter of the front face, said frame including a plurality of frame supports.

In a eighteenth embodiment, this invention provides a container as in either the sixteenth or seventeenth embodiment above, wherein said collapsible backing is made of a flexible film.

In a nineteenth embodiment, this invention provides a container as any of the sixteenth through eighteenth embodiments above, wherein said collapsible backing includes fold lines and said collapsible backing collapses along said fold lines as said container volume decreases.

In a twentieth embodiment, this invention provides a container as any of the sixteenth through nineteenth embodiments above, wherein said collapsible backing includes: a rear wall opposite said front face; right and left side walls interconnecting said front face and said rear wall; a bottom wall interconnecting with said front face, rear wall, right side wall and left side wall; a top wall interconnecting with said front face, rear wall, right side wall and left side wall; a rear wall upper fold line extending across said rear wall, said rear wall upper fold line separating said rear wall into an upper facet between said rear wall upper fold line and said top wall and a central facet between said rear wall upper fold line and said bottom wall, wherein the removal of product from said container causes said container volume to decrease, and, as said container volume decreases, said container folds along said rear wall upper fold line such that said upper facet folds down toward said central facet and said front wall is devoid of a fold line that mimics the structure and function of said rear wall upper fold line such that the folding at said rear wall upper fold line is not simulated at said front wall and said front wall retains its shape.

In a twenty-first embodiment, this invention provides a container as any of the sixteenth through twentieth embodiments above, wherein, as additional portions of said product are removed from said container volume and the container approaches the empty configuration, at least a portion of said collapsible backing comes into close proximity to said front face.

In a twenty-second embodiment, this invention provides a container as any of the sixteenth through twenty-first embodiments above, wherein at least a portion of said front face is transparent or translucent.

In a twenty-third embodiment, this invention provides a container as any of the sixteenth through twenty-second embodiments above, wherein said collapsible backing has an interior surface, and indicia is provided on said interior surface such that said indicia is visible through said transparent or translucent portion of said front face when said interior surface approaches near or contacts said front face.

In a twenty-fourth embodiment, this invention provides a container as any of the sixteenth through twenty-third embodiments above, wherein said indicia provides notice that the container is nearly empty.

In a twenty-fifth embodiment, this invention provides a container as any of the sixteenth through twenty-fourth embodiments above, wherein said front face is formed of a material that resists puncturing.

In a twenty-sixth embodiment, this invention provides a container as any of the sixteenth through twenty-fifth embodiments above, further comprising a pump that is actuated to dispense a dose of said product from said container.

In a twenty-seventh embodiment, this invention provides a dispenser comprising: a housing defining a volume for receipt of a collapsible container, said housing including; a front wall having a sight window allowing for viewing of at least a portion of the interior of the housing, and tensioning mounts; and a collapsible container retained within said housing, said container being collapsible from a filled configuration to a substantially empty configuration during dispensing of the contents therein, the container comprising: a front face having a perimeter, positioned in close proximity to said sight window of said housing, a frame defined around at least a portion of said perimeter of said front face, frame supports in said frame; a collapsible backing secured to said front face to define a container volume, and product retained within said container volume, wherein a dose of product is dispensed from said container volume upon actuation of the dispenser, wherein the container is sealed such that the dispensing of a dose of product from said container volume causes said container volume to decrease, and, as said container volume decreases, said collapsible backing collapses by vacuum toward said front face, said front face being held in place by the interaction of said tensioning mounts and said frame supports such that said front face is retained in place as said collapsible backing collapses such that said front face remains in close proximity to said sight window.

In a twenty-eighth embodiment, this invention provides a container as in the twenty-seventh embodiment, wherein said sight window is a simple aperture, devoid of a transparent covering, said front face of said container serving as such a covering.

In a twenty-ninth embodiment, this invention provides a container as in either of the twenty-seventh or twenty-eighth embodiments above, wherein said rigid front face includes graphics or text.

In a thirtieth embodiment, this invention provides a container as any of the twenty-seventh through twenty-ninth embodiments above, further comprising a pump, said pump being actuated upon actuation of the dispenser, and actuation of said pump dispenses a dose of said product from said container volume.

In a thirty-first embodiment, this invention provides a container as any of the twenty-seventh through thirtieth embodiments above, wherein said front face is formed of a flexible film.

In a thirty-second embodiment, this invention provides a dispenser comprising: a housing defining a volume for receipt of a collapsible container, said housing including a front wall having a sight window allowing for viewing of at least a portion of the interior of the housing; and a collapsible container retained within said housing, said container being collapsible from a filled configuration to a substantially empty configuration during dispensing of the contents therein, the container comprising: a front face positioned in close proximity to said sight window of said housing, a collapsible backing secured to said front face to define a container volume, and product retained within said container volume, wherein a dose of product is dispensed from said container volume upon actuation of the dispenser, wherein the container is sealed such that the dispensing of a dose of product from said container volume causes said container volume to decrease, and, as said container volume decreases, said collapsible backing collapses by vacuum toward said front face, said front face being adapted to retain its shape as said collapsible backing collapses, such that said front face remains in close proximity to said sight window.

DETAILED DESCRIPTION OF ILLUSTRATIVE EMBODIMENTS

Figure 1:
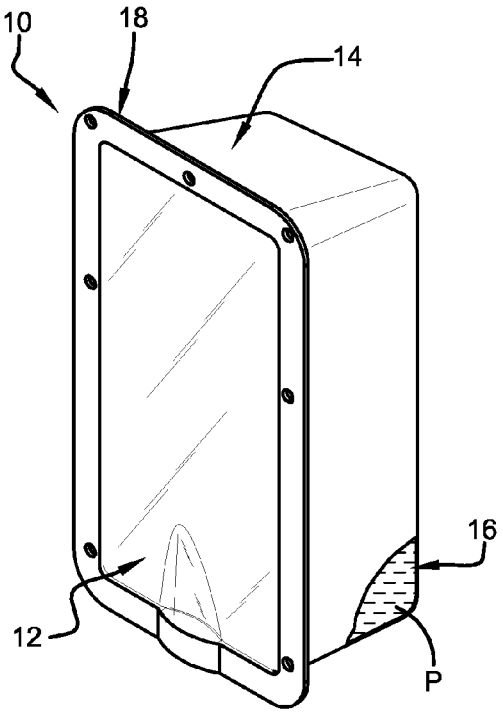
FIG. 1 is a perspective view of a generic collapsible container in accordance with the present invention and generally applicable to all embodiments.
Figure 2:
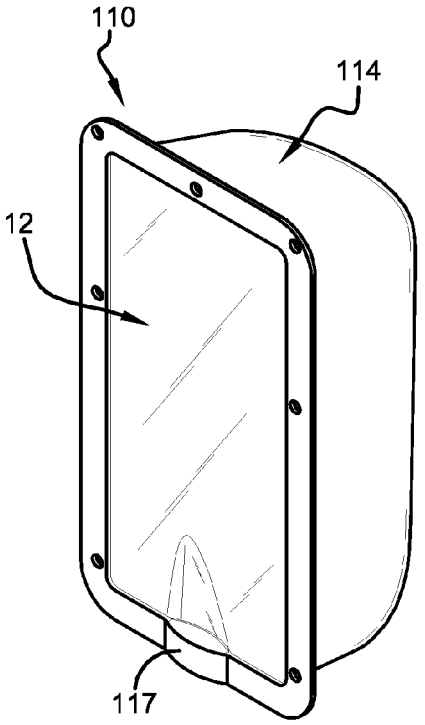
FIG. 2 is a perspective view of an embodiment of a collapsible container in accordance with this invention, employing a flexible film material for the collapsible backing.
Figure 3:
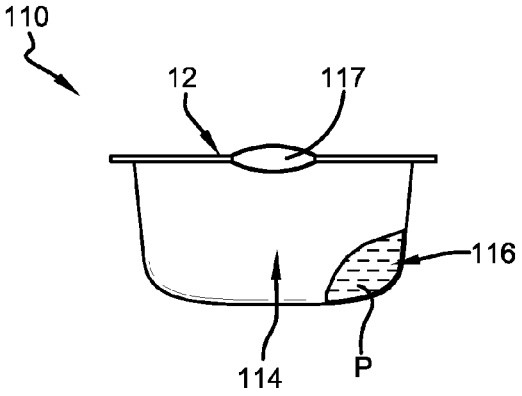
FIG. 3 is a bottom plan view of the collapsible container embodiment of FIG. 2.
Figure 4:
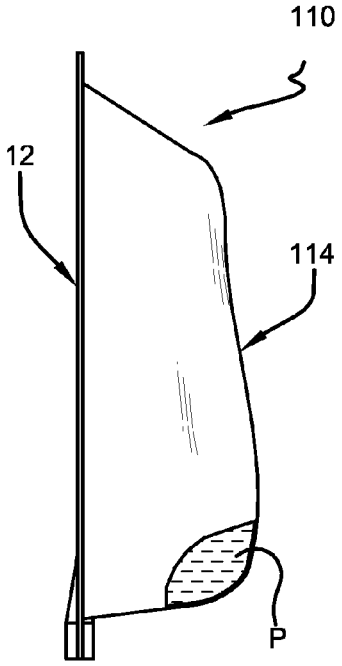
FIG. 4 is a side elevation view of the collapsible container embodiment of FIG. 2, shown as it begins to collapse due to the removal of product.
Figure 5:
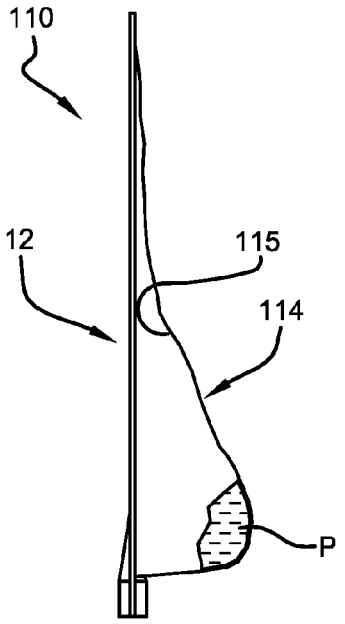
FIG. 5 is a side elevation view, as in FIG. 4, but showing the container upon further collapse due to the removal of yet more product as compared to FIG. 5.
Figure 6:
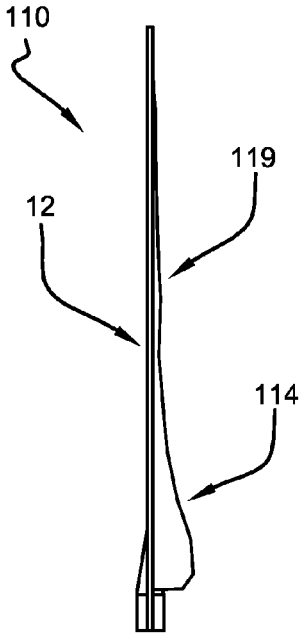
FIG. 6 is a side elevation view as in FIGS. 4 and 5, but showing the container upon further collapse due to the removal of yet more product as compared to FIGS. 4 and 5, wherein a portion of the collapsible backing has been drawn by vacuum to contact or lie in very close proximity to the front face.

The present invention provides a new approach to providing collapsible containers for product dispensers. The present invention also provides new dispensers employing such collapsible containers. The collapsible containers are all conceptually similar, though a multitude of embodiments are encompassed by the general concepts herein. The focus is on retaining the shape of the front face of the collapsible container, and this can be achieved in a number of ways, the various embodiments of which are described herein. With reference to FIG. 1, which represents a generic embodiment of the invention, a collapsible container 10 includes a front face 12 and a collapsible backing 14, wherein the container volume 16 is not vented, such that, as product P is removed, the collapsible backing 14 collapses by vacuum as the container volume 16 decreases.

In some embodiments, the front face is flexible and thus susceptible to losing its original shape as the container volume decreases, but is nevertheless designed to retain its shape by having a frame around at least a portion of its perimeter. In other embodiments, the front face is adapted to retain its shape as the collapsible backing collapses upon a decrease in the container volume. Though a frame, such as frame 18 of FIG. 1, is shown extending around a perimeter of the front face in all embodiments, it should be appreciated that the frame can be omitted in embodiments where the front face is adapted to retain its shape. With the understanding that the front face is to retain its shape, this disclosure first addresses the embodiments of the collapsible backing, and the embodiments of the front face will be addresses thereafter.

In some embodiments, the collapsible backing is flexible and collapses similar to the manner in which a film bag would collapse upon the removal of product. In other embodiments, the collapsible backing is more structured and somewhat rigid, but collapses due to a special structuring of the collapsible backing. This special structuring may take the form of fold lines in the walls of the collapsible backing or the provision of walls of variable thickness or the provision of stepped walls or shaped walls. The options for the front face and collapsible backing can be combined in any manner to create a collapsible container in accordance with this invention and thus, the summary of invention sets forth a multitude of combination of features. The present disclosure provides specific non-limiting examples of particular embodiments.

A first embodiment of a collapsible backing in accordance with the present invention is characterized by being made of a flexible, film-like material. This embodiment is shown in FIGS. 2-8 as part of a collapsible container designated by the numeral 110. The collapsible container 110 includes a front face 12 to which a collapsible backing 114 is secured to define a container volume 116. A product P is retained within the container volume 116, and the container volume is sealed such that the removal of a portion of the product P from the container volume 116 causes the container volume to decrease. As the container volume 116 decreases, the collapsible backing 114 will collapse because the container is not vented and thus air cannot enter to replace the product being removed. The collapsible container 110 is shown with an opening 117 at its base, particularly at a location where the front face 12 and collapsible backing 114 meet at the base of the container, but it will be appreciated that this opening 117 is typically sealed off so that, when product is removed from the container 110 the volume of the container 110 necessarily decreases such that the collapsible backing 114 must collapse as it is designed to do in accordance with this invention. The container 110 is shown without the opening 117 being sealed in FIGS. 2-7, because the manner in which the opening 117 is sealed so that the collapsible backing 114 collapses upon the removal of product is not material to the broadest embodiment of the present invention. Nevertheless, the container 110 is shown at various stages of collapse in FIGS. 4-7. In other embodiments, the opening 117 may be sealed by a pump 111, as seen in FIG. 8 but, again, in the broadest sense, this invention relates to a collapsible container without regard to how it might be sealed at an opening (such as opening 117) through which product is removed.

Figure 7:
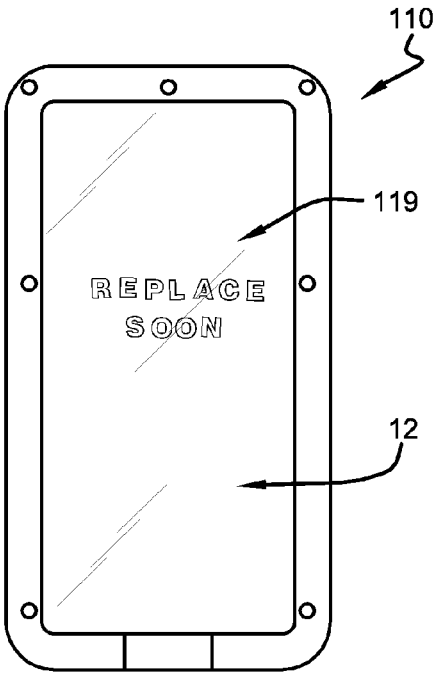
FIG. 7 is a front elevation view of FIG. 6, showing a notice on the flexible backing being viewed at the front face, the notice providing an indication that the container will need to be replaced soon.
Figure 8:
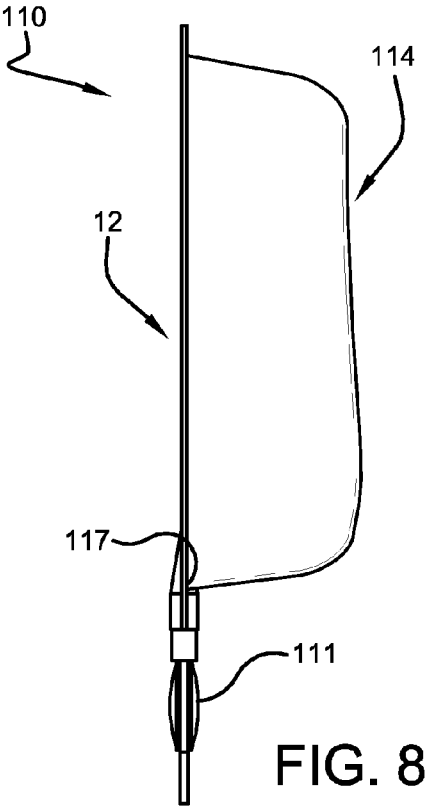
FIG. 8 is a side elevation view of the collapsible container of FIG. 2, shown with a pump secured at the bottom thereof.
Figure 9:
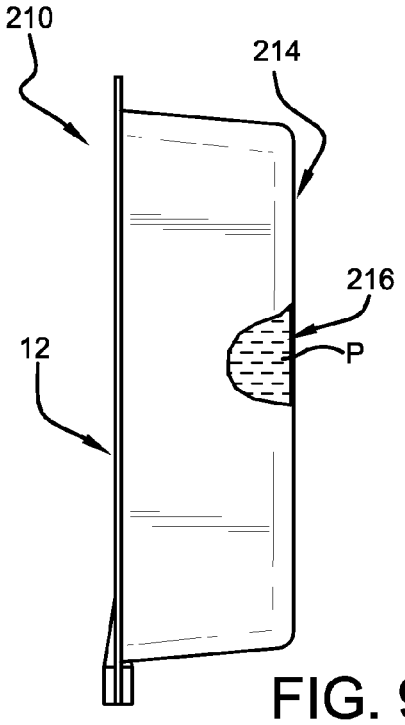
FIG. 9 is a side elevation view of an embodiment of a collapsible container in accordance with this invention, employing a more structured collapsible backing.
Figure 10:
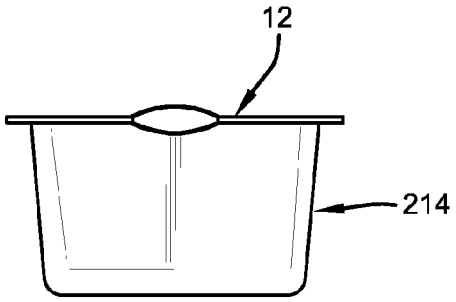
FIG. 10 is a bottom plan view of the collapsible container embodiment of FIG. 9.

As noted, in this embodiment, the collapsible backing 114 is a highly flexible film or foil or similar material. Thus, as product P is dispensed and the container volume 116 decreases, the flexible material forming the collapsible backing 114 collapses in on itself and toward the front face 12, as seen in FIGS. 4-7. Eventually, as seen in FIG. 7, at least a portion of the flexible material of the collapsible backing 114 will be drawn into contact the front face 12, as seen at 119 (FIG. 6) and this occurrence can be advantageously employed. More particularly, in some embodiments, indicia can be printed on an interior surface 115 of the collapsible backing 114, the indicia being placed such that it will be visible through the front face 12 when the interior surface 115 approaches near or contacts the front face 12. The indicia may be any desired notice of graphic, but in this embodiment is shown as a replacement notice, using the words "Replace Soon" indicating to maintenance personnel (or other appropriate entities) that the collapsible container 110 is nearly empty.

The materials for the highly flexible collapsible backing 114 may be chosen from virtually any material that provides a bag-like amorphous collapsing structure. Suitable materials will be apparent to those of skill in the art and might include, without limitation, polymer films such as biaxially-oriented polyethylene terephthalate (e.g., Mylar™), nylon, low density polyethylene and the like.

The highly flexible collapsible backing 114 may be used with front faces 12 that are also themselves flexible and thus collapsible or may be used with front faces 12 that are adapted to retain their shape. These options for the front face 12, will be described more fully below, but other embodiments of collapsible backings are first disclosed.

A second embodiment of a collapsible backing in accordance with the present invention is characterized by having a more structured shape, instead of the amorphous bag-like shape of the prior embodiment. This is achieved by forming the collapsible backing from a material that will substantially retain its manufactured shape until product is removed from the collapsible container, causing a decrease in the container volume that leads to a collapsing of the collapsible backing structure.

This embodiment is shown in FIGS. 9-13 as part of a collapsible container designated by the numeral 210. The container 210 includes a front face 12 to which a collapsible backing 214 is secured to define a container volume 216. A product P is retained within the container volume 216, and the container volume is sealed (as for example with a pump (not shown) as disclosed with reference to FIG. 8) such that the removal of a portion of the product P from the container volume 216 causes the container volume to decrease. As the container volume 216 decreases, the collapsible backing 214 will collapse because the container is not vented and thus air cannot enter to replace the product being removed. The collapsible backing 214 of this embodiment is characterized by being formed of a material that will substantially retain its manufactured shape but yet will readily buckle, bend, fold and otherwise collapse as product is removed form the collapsible container 210, causing a decrease in the container volume 216.

Figure 11:
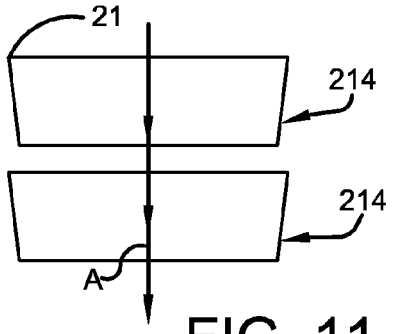
FIG. 11 is a side elevation view of two collapsible backings of the embodiment of FIG. 9, showing that they are preferably structured to intimately stack within each other.

In particularly advantageous embodiments, the collapsible backing 214 is formed such that multiple collapsible backings 214, without front faces 12 fitted thereto, can nest within each other, as represented in FIG. 11. This is achieved by defining an axis A through the open mouth 21, extending in the nesting direction, and having no surfaces parallel to this axis A. This general concept is generally known in the art of stacking containers. This is advantageous because the elements necessary to form a completed collapsible container, i.e., front faces, collapsible backings, can be stored in a minimal amount of space until it is desired to fill them.

The materials for the collapsible backing 214 of this invention will be apparent to those of ordinary skill in the art, and, in particular non-limiting embodiments, the collapsible backing 214 is formed of polyethylene terephthalate (PET), nylon, low density polyethylene (LDPE) and the like. Due consideration is given to creating the collapsible backing 214 with thin walls that will buckle, bend, fold and otherwise collapse in a generally repeatable though not necessarily controlled manner (as in other embodiments described later herein). The material may be drawn or thermoformed or otherwise produced. The drawing method allows a stock sheet of material to be heated and drawn to the desired shape, the heating and drawing can be controlled to produce thinner and thicker walls to influence the collapsing.

Figure 12:
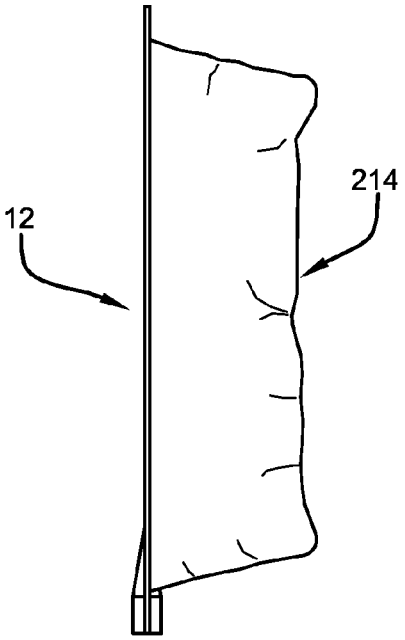
FIG. 12 is a side elevation view of the collapsible container embodiment of FIG. 9, shown as it begins to collapse due to the removal of product.
Figure 13:
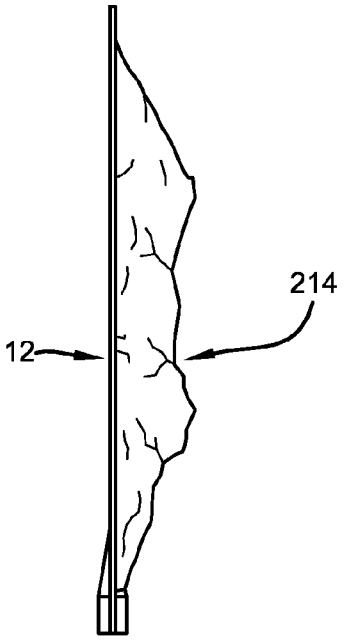
FIG. 13 is a side elevation view, as in FIG. 12, but showing the container upon further collapse due to the removal of yet more product as compared to FIG. 12.

Thus, as product P is dispensed and the container volume 216 decreases, the material forming the collapsible backing 214 collapses in on itself, buckling, bending, folding and kinking as it collapses, as represented by the various and generally random contour lines drawn in FIGS. 12 and 13. The rear wall 220 will be pulled toward the front face 12, and eventually, as least a portion of the material of the collapsible backing 214 will be drawn into contact or will at least lie in close proximity to the front face 12, as already noted with respect to the previous embodiment. Therefore, in some embodiments, indicia can be printed on an interior surface of the collapsible backing 214, to be visible through the front face 12 when the interior surface approaches near or contacts the front face 12.

A third embodiment of a collapsible backing in accordance with the present invention is characterized by having a structured shape that is structured to collapse in a more controlled manner. Various exemplary embodiments are shown herein. The structured shape is achieved by forming the collapsible backing from a material that will substantially retain its manufactured shape until product is removed from the collapsible container, causing a decrease in the container volume that leads to a collapsing of the collapsible backing structure. The collapsing in controlled by the provision of stronger and weaker portions of the collapsible backing.

Figure 14:
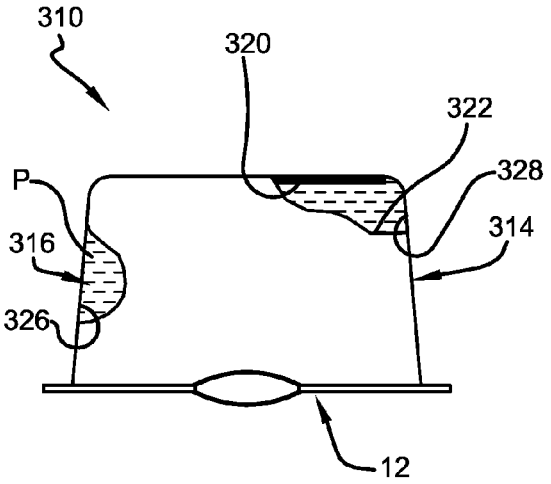
FIG. 14 is a bottom plan view of an embodiment of a collapsible container in accordance with this invention, employing a collapsible backing structure that collapses in a controlled manner due to sidewalls being more readily collapsible than the front and rear walls.
Figure 15:
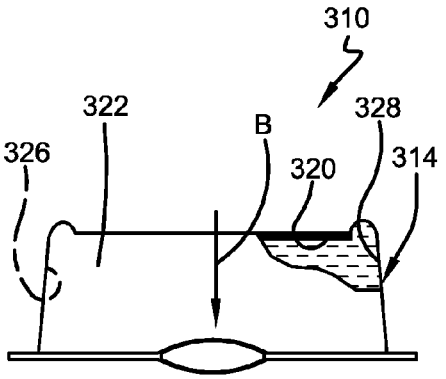
FIG. 15 is a bottom plan view of the embodiment of FIG. 14, shown as it begins to collapse due to the removal of product.

A first embodiment of a collapsible backing that is to collapse in a more controlled manner is shown in FIGS. 14-15 as part of a collapsible container designated by the numeral 310. Having disclosed other embodiments in more detail, these limited views are quite sufficient for an understanding of this embodiment. The container 310 includes a front face 12 to which a collapsible backing 314 is secured to define a container volume 316. A product P is retained within the container volume 316, and the container volume is sealed, as previously described, such that the removal of a portion of the product P from the container volume 316 causes the container volume to decrease. As the container volume 316 decreases, the collapsible backing 314 will collapse because the container is not vented and thus air cannot enter to replace the product being removed. The collapsible backing 314 of this embodiment is characterized by being formed of a material that will substantially retain its manufactured shape but yet will collapse in a generally controlled manner as a result of having a top wall, a bottom wall and side walls that are relatively weaker than a rear wall.

More particularly, the collapsible backing 314 includes a rear wall 320 that is separated from the front face 12 by a top wall (not seen), a bottom wall 322, a left sidewall 326 and a right side wall 328. The rear wall 320 is opposite the front face 12, and the left side wall 326 and right side wall 328 interconnect the front face 12 with the rear wall 328 and the top wall (not seen) with the bottom wall 322. Similarly, the bottom wall 322 interconnects with the front face 12, the rear wall 320, the left side wall 326 and the right side wall 328, as does the top wall. In this embodiment, the bottom wall 322, the top wall, the left side wall 326 and the right sidewall 328 are all formed to be weaker than the rear wall 320 such that, as product P is dispensed and the container volume 316 decreases, the material forming the bottom wall 322, the top wall, the left side wall 326 and the right side wall 328 collapses in on itself, while the stronger rear wall 320 tends to retain its shape, and is thus drawn toward the front face 12 as represented by the arrow B in FIG. 15. The rear wall 320 will be pulled toward the front face 12, and eventually, as least a portion of the material of the collapsible backing 314 at the rear wall 320 will be drawn into contact or will at least lie in close proximity to the front face 12, as already noted with respect to the previous embodiment. Therefore, in some embodiments, indicia can be printed on an interior surface of the collapsible backing 314 at the rear wall 320, to be visible through the front face 12 when the interior surface approaches near or contacts the front face 12.

In particularly advantageous embodiments, the collapsible backing 314 is formed such that multiple collapsible backings 314, without front faces 12 fitted thereto, can nest within each other, as disclosed already with respect to FIG. 11. The materials for the collapsible backing 314 of this invention will be apparent to those of ordinary skill in the art, and, in particular non-limiting embodiments, the collapsible backing 314 is formed of polyethylene terephthalate (PET), nylon, LDPE and the like. Due consideration is given to creating the collapsible backing 314 with weaker top, bottom and side walls relative to a stronger rear wall to achieve the controlled collapse just disclosed. The material may be drawn or blow molded or otherwise produced. The drawing method allows a stock sheet of material to be heated and drawn to the desired shape, the heating and drawing can be controlled to produce thinner and thicker walls to influence the collapsing. Particularly, in some embodiments, the weaker walls are created by heating and drawing the top, bottom and side walls to be thinner than the relatively thicker rear wall.

Figure 16:
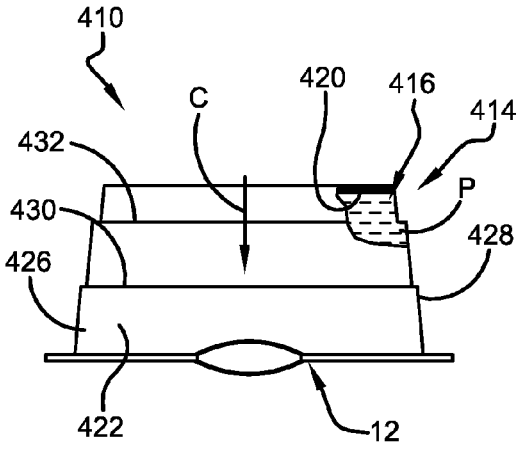
FIG. 16 is a bottom plan view of an embodiment of a collapsible container in accordance with this invention, employing a collapsible backing structure that collapses in a controlled manner due to being of a stepped structure with sidewalls being more readily collapsible than the front or rear walls.
Figure 17:
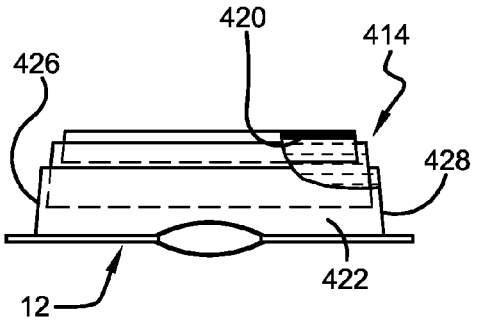
FIG. 17 is a bottom plan view of the embodiment of FIG. 16, shown as it begins to collapse due to the removal of product.
Figure 18:
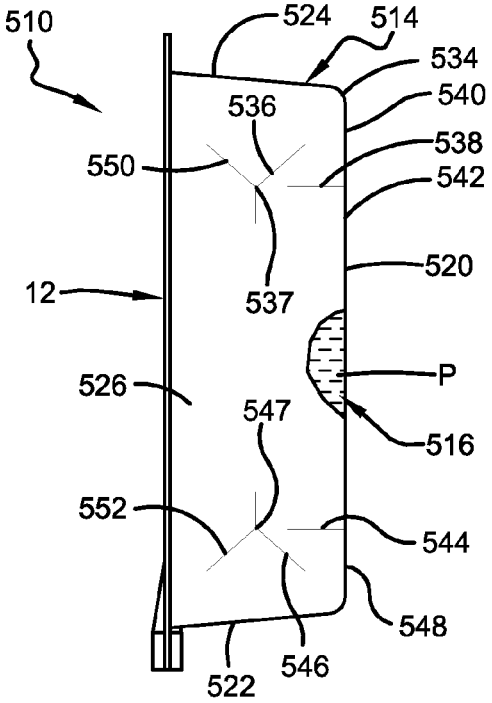
FIG. 18 is a side elevation view of an embodiment of a collapsible container in accordance with this invention, employing a collapsible backing structure that collapses in a controlled manner due to having fold lines worked into the collapsible backing.
Figure 19:
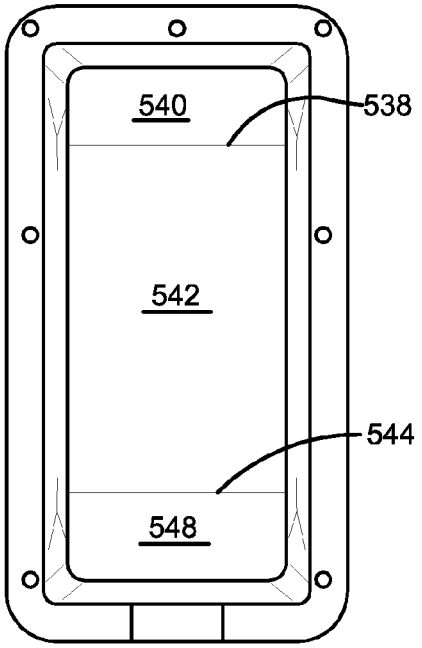
FIG. 19 is a rear elevation view of the embodiment of FIG. 18.

A second embodiment of a collapsible backing that is to collapse in a more controlled manner is shown in FIGS. 16-17 as part of a collapsible container designated by the numeral 410. Having disclosed other embodiments in more detail, these limited views are quite sufficient for an understanding of this embodiment. The container 410 includes a front face 12 to which a collapsible backing 414 is secured to define a container volume 416. A product P is retained within the container volume 416, and the container volume is sealed, as previously described, such that the removal of a portion of the product P from the container volume 416 causes the container volume to decrease. As the container volume 416 decreases, the collapsible backing 414 will collapse because the container is not vented and thus air cannot enter to replace the product being removed. The collapsible backing 414 of this embodiment is characterized by being formed of a material that will substantially retain its manufactured shape but yet will collapse in a generally controlled manner as a result of having a stepped construction to its top wall, bottom wall and side walls that are relatively weaker than a rear wall.

More particularly, the collapsible backing 414 includes a rear wall 420 that is separated from the front face 12 by a top wall (not seen), a bottom wall 422, a left sidewall 426 and a right side wall 428. The rear wall 420 is opposite the front face 12, and the left side wall 426 and right side wall 428 interconnect the front face 12 with the rear wall 428 and the top wall (not seen) with the bottom wall 422. Similarly, the bottom wall 422 interconnects with the front face 12, the rear wall 420, the left side wall 426 and the right side wall 428, as does the top wall. In this embodiment, the bottom wall 422, the top wall, the left side wall 426 and the right sidewall 428 are all formed with a stepped structure, as at steps 430 and 432 to be weaker than the rear wall 420 such that, as product P is dispensed and the container volume 416 decreases, the material forming the bottom wall 422, the top wall, the left side wall 426 and the right side wall 428 collapses in on itself, while the stronger rear wall 420 tends to retain its shape, and is thus drawn toward the front face 12 as represented by the arrow C in FIG. 16. The rear wall 420 will be pulled toward the front face 12, while the bottom wall 422, the top wall, the left side wall 426 and right side wall 428 telescope (i.e., slide into themselves) at the steps 430, 432 so as to collapse, and, eventually, as least a portion of the material of the collapsible backing 414 at the rear wall 420 will be drawn into contact or will at least lie in close proximity to the front face 12, as already noted with respect to the previous embodiment. Therefore, in some embodiments, indicia can be printed on an interior surface of the collapsible backing 414 at the rear wall 420, to be visible through the front face 12 when the interior surface approaches near or contacts the front face 12.

In particularly advantageous embodiments, the collapsible backing 414 is formed such that multiple collapsible backings 414, without front faces 12 fitted thereto, can nest within each other, as disclosed already with respect to FIG. 11. The materials for the collapsible backing 414 of this invention will be apparent to those of ordinary skill in the art, and, in particular non-limiting embodiments, the collapsible backing 414 is formed of polyethylene terephthalate (PET), nylon, LDPE and the like. Due consideration is given to creating the collapsible backing 414 with weaker and stepped top, bottom and side walls relative to a stronger rear wall to achieve the controlled collapse just disclosed. The material may be drawn or thermoformed or otherwise produced. The drawing method allows a stock sheet of material to be heated and drawn to the desired shape, the heating and drawing can be controlled to produce thinner and thicker walls to influence the collapsing. Particularly, in some embodiments, the weaker walls are created by heating and drawing the top, bottom and side walls to be thinner than the relatively thicker rear wall.

A third embodiment of a collapsible backing in accordance with the present invention is characterized by having a structured shape that is structured to collapse in a more controlled manner. This embodiment is shown in FIGS. 18-21 and can be more particularly appreciated from a review of U.S. patent application Ser. No. 13/031,875, incorporated herein by reference. This embodiment is designated by the numeral 510. The container 510 includes a front face 12 to which a collapsible backing 514 is secured to define a container volume 516. A product P is retained within the container volume 216, and the container volume is sealed (as for example with a pump (not shown) as disclosed with reference to FIG. 8) such that the removal of a portion of the product P from the container volume 216 causes the container volume to decrease and the collapsible backing to collapse. The collapsible backing 214 of this embodiment is characterized by having fold lines that facilitate its collapsing in a controlled and desired manner. The collapsible backing can be formed of somewhat rigid material that holds its shape until collapsing in a controlled manner due to the fold lines.

With reference to FIGS. 18-21, the collapsible backing 514 includes a rear wall 520, a bottom wall 522, a top wall 524, a left side wall 526 and a right side wall (not shown, but similar to left side wall 526). The rear wall 520 is opposite the front face 12, and the left side wall 526 and right side wall interconnect the front face 12 with the rear wall 520 and the top wall 524 with the bottom wall 522. Similarly, the top wall 524 interconnects with the front face 12, the rear wall 520, the left side wall 526 and the right side wall, as does the bottom wall 522. The transitions between the various walls may be slightly rounded or angled, as seen in the figures, for example at the transition 534 between the rear wall 520 and the top wall 524.

The left side wall 526 includes a first upper left wall fold line 536 that extends in a general diagonal direction downwardly (in the orientation shown) and away from the rear wall 520 from a first end, proximate the intersection of the top wall 524 and the rear wall 520, to a second end 537 positioned within the surface area defined by the left side wall 526. In particular embodiments, such as that shown, the second end terminates at the horizontal center of the left side wall 526. The right side wall, which is not viewed in FIGS. 18-21 would mimic the left side wall 526 and the fold lines disclosed with respect to the left side wall 526 would be included in the right side wall. These and other "fold lines" disclosed herein are defined by slight detents or weaknesses (such as creases) formed in the surface of the various walls in which they are positioned. In other embodiments, they may be formed by creases pre-formed into the wall surfaces. In particular embodiments, they are detents that extend in the direction in which the fold line moves during collapse, as perhaps best seen at fold line 538 in rear wall 520 (and disclosed more fully below). When the volume of the collapsible container 510 begins to decrease due to the removal of product, the container 510 will tend to fold along these fold lines, and will at least fold more readily along these "fold lines" as compared to folding, twisting or buckling or otherwise collapsing along other portions of the container's surface area.

The rear wall 520 includes a rear wall upper fold line 538 that extends across the rear wall 520 (see rear view of FIG. 19) to separate the rear wall 520 into an upper facet 540 and a central facet 542. In particular embodiments, the rear wall upper fold line 538 extends horizontally across the rear wall at a position vertically aligned with the second end 537 of the first upper left wall fold line 536. This would also align with a similar second end of the similar fold line in the right side wall. The rear wall upper fold line 538 separates the rear wall 520 into an upper facet 540, extending above the rear wall upper fold line 538 and a central facet 542 extending below the rear wall upper fold line 538 but above a rear wall lower fold line 544.

The left side wall 526 also includes a first lower left wall fold line 546 that extends in a general diagonal direction upwardly (in the orientation shown) and away from the rear wall 520 from a first end, proximate the intersection of the bottom wall 522 and the rear wall 520, to a second end 547 positioned within the surface area defined by the left side wall 526. In particular embodiments, such as that shown, the second end terminates at the horizontal center of the left side wall 526. As mentioned, the right side wall would mimic the left side wall 526.

The rear wall 520 also includes a rear wall lower fold line 544 that extends across the rear wall 520 (see rear view of FIG. 19) to separate the rear wall 520 into a lower facet 548 and the central facet 542. In particular embodiments, the rear wall lower fold line 544 extends horizontally across the rear wall 520 at a position vertically aligned with the second end 547 of the first lower left wall fold line 546. This would also align with a similar second end of the similar fold line in the right side wall. The rear wall lower fold line 544 separates the rear wall 520 into a lower facet 548, extending below the rear wall lower fold line 544 and further defines the central facet 542.

In a particular embodiment that is more simplified than the specific embodiment shown, the container 510 is provided with the aforementioned first upper left wall fold line 536 (and similar fold line in the right sidewall), rear wall upper fold line 538, first lower left wall fold line 546 (and similar fold line in the right sidewall) and rear wall lower fold line 544, and, when the container is sealed such that the removal of product causes the container volume 516 to decrease, the container folds along the fold lines such that the upper facet 540 folds down toward the central facet 542, while the lower facet 548 folds upwardly toward the central facet, resulting a more controlled collapsing of the container. The more controlled collapsing is realized because the container tends to collapse along the aforementioned fold lines and thus collapses in a repeatable manner, and portions of the container tend to remain more substantially flat as compared to collapsible containers of the prior art. The top wall 524 remains substantially flat while collapsing, the top wall 524 pivoting downwardly at a pivot point proximate the joining of the top wall 524 and the front face 12, as the upper facet 540 folds down, about rear wall upper fold line 538, toward the central facet 542. In the present example, the upper facet 540 and central facet 542 tend to remain substantially flat during the collapsing of the container, which further tends to keep the top wall 524 substantially flat. Similarly, the bottom wall 522 remains substantially flat while collapsing, the bottom wall 522 pivoting upwardly at a pivot point proximate the joining of the bottom wall 522 and the front face 12, as the lower facet 548 folds up, about rear wall lower fold line 544, toward the central facet 542. In the present example, the lower facet 548 and central facet 542 tend to remain substantially flat during the collapsing of the container, which further tends to keep the bottom wall 522 substantially flat. Without the fold lines the container would instead warp and collapse in a more random manner without substantially flat facets.

In other embodiments, the collapsible container 510 further includes a second upper left wall fold line 550 in the left side wall 526 that extends (in the orientation shown) in a general diagonal direction downwardly and from a first end proximate the intersection of the top wall 524 and the front face 12 to a second end that intersects with the second end 537 of the first upper left wall fold line 536 and creates a general V-shape. This defines a V-shaped facet in the upper portion of the left side wall 526, the V-shaped facet being defined between the first and second upper left wall fold lines 536, 550 and the top wall 524. Similarly, the collapsible container 510 further includes a second lower left wall fold line 552 in the left side wall 526 that extends (in the orientation shown) in a general diagonal direction upwardly and from a first end proximate the intersection of the bottom wall 522 and the front face 12 to a second end that intersects with the second end 547 of the first lower left wall fold line 546 and creates a general V-shape. This defines a V-shaped facet in the lower portion of the left side wall 526, the V-shaped facet being defined between the first and second lower left wall fold lines 546, 552 and the bottom wall 522. Similar structures are repeated at the right side wall.

In yet other embodiments, the aforementioned V-shapes created by the fold lines are instead formed into Y shapes due to the inclusion of vertical fold lines, one extending downwardly from end 537 and one extending upwardly form end 547. Notably, this fold line can extend for a very limited vertical length, so as to be just sufficient to encourage vertical folding as discussed below, and can also extend for a significant vertical length, even to the point of joining ends 537 and 547.

Figure 20:
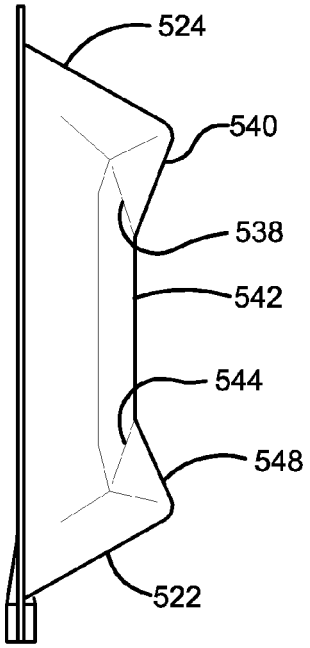
FIG. 20 is a side elevation view of the collapsible container embodiment of FIG. 18, shown as it begins to collapse due to the removal of product.
Figure 21:
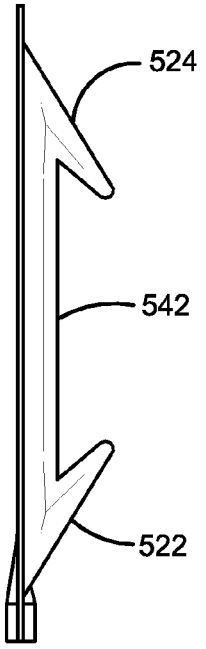
FIG. 21 is a side elevation view, as in FIG. 20, but showing the container upon further collapse due to the removal of yet more product as compared to FIG. 20.

As can be seen in FIGS. 20 and 21, as the volume of container 510 decreases, the container 510 folds along the first and second upper left wall fold lines 536, 550 (and the similar fold lines in the right side wall), such that the V-shaped facets therebetween fold inwardly. Additionally, the left side wall 526 collapses inwardly about a line extending generally vertically downwardly from end 537 (and the right side wall collapses similarly). When the aforementioned left and right side wall vertical fold lines (forming Y-shaped fold line intersections) are employed, this collapsing inwardly about a generally vertical line is facilitated. Similarly, as the volume of container 510 decreases, the container 510 folds along the first and second lower left wall fold lines 548, 552 (and the similar fold lines in the right side wall), such that the V-shaped facets therebetween fold inwardly. Additionally, the left side wall 526 collapses inwardly about a line extending generally vertically upwardly from end 547 (and the right side wall collapses similarly). When the aforementioned left and right side wall vertical fold lines (forming Y-shaped fold line intersections) are employed, this collapsing inwardly about a generally vertical line is facilitated. The inward collapsing of the left side wall 526 is generally represented in FIG. 20 at line 554.

With continued reference to FIGS. 20 and 21 it can be seen that the upper facet 540 of the rear wall 520 folds downwardly toward the central facet 542, while the top wall 524 folds proximate its contact with the front face 12. Similarly, the lower facet 548 of the rear wall 520 folds upwardly toward the central facet 542, while the bottom wall 522 folds proximate its contact with the front face 12. Furthermore, the V-shaped facets fold inwardly. It will be appreciated that the folding at the upper portion and bottom portion closely mimics the folding of a common brown paper grocery bag or lunch bag, and the central facet 542 can remain substantially flat as it is drawn toward the front face 12. Eventually, as least a portion of the material of the collapsible backing 514 at the rear wall 520 will be drawn into contact or will at least lie in close proximity to the front face 12, as already noted with respect to previous embodiments. Therefore, in some embodiments, indicia can be printed on an interior surface of the collapsible backing 514 at the rear wall 520, to be visible through the front face 12 when the interior surface approaches near or contacts the front face 12. In this embodiment, indicia may be particularly placed on the interior surface of the central facet.

In particularly advantageous embodiments, the collapsible backing 514 is formed such that multiple collapsible backings 514, without front faces 12 fitted thereto, can nest within each other, as disclosed already with respect to FIG. 11. The materials for the collapsible backing 514 of this invention will be apparent to those of ordinary skill in the art, and, in particular non-limiting embodiments, the collapsible backing 514 is formed of polyethylene terephthalate (PET), nylon, LDPE and the like. Due consideration is given to creating the fold lines as described herein. The material may be drawn or blow molded or otherwise produced. The drawing method allows a stock sheet of material to be heated and drawn to the desired shape, the heating and drawing can be controlled to produce thinner and thicker walls to influence the collapsing, and the mold may include ribs and the like to impart the fold lines to the collapsible backing.

It was originally noted above that, in some embodiments, the front face 12 could be designed to be flexible and thus susceptible to losing its original shape as the container volume decreases. However, it was further noted that the front face 12 would nevertheless be designed to retain its shape by having a frame around at least a portion of its perimeter. It was also noted that, in other embodiments, the front face 12 could be adapted to retain its shape as the collapsible backing collapses upon a decrease in the container volume, and, when so adapted, the frame could be omitted. With this understanding in mind, the embodiments of the collapsible backing disclosed above were shown collapsing as the front face 12 retained its original shape. The disclosure now turns to a description of how shape retention at the front face is achieved, starting first with the embodiments of a front face that is to retain its shape, thereafter addressing embodiments of a front face that is flexible and susceptible to losing its original shape.

In some embodiments, the front face 12 is rigid so as to resist deformation. This is referred to herein as a front face that is adapted to retain its shape. It is also referred to as a "shape-retaining front face" and the material forming it may be referred to as "shape-retaining material." In such embodiments, as the container volume decreases due to the removal of product, the collapsible backing is drawn, by vacuum, toward the front face 12, as shown in FIGS. 4, 5, 6, 12, 13, 15, 17, 20 and 21, and the front face 12 retains its structure due to the judicious choice of shape-retaining material for the front face 12. Indeed, the front face 12 can be made from virtually any material that retains its shape upon the generation of the vacuum created upon the removal of product from the container volume. Although the selection of a suitable shape-retaining material will be apparent to those of ordinary skill in the art, particular suitable materials for the rigid front face 12 may be selected from polyethylene terephthalate (PET), nylon, LDPE and the like. Additionally, while the front face 12 may be substantially planar in particular embodiments, it may be otherwise shaped in other embodiments. The front face 12 may also be transparent or translucent or partially so, such that the product therein can be seen through the front face 12. In other embodiments, the front face 12 may be partially transparent or translucent with graphics and/or text thereon. In other embodiments, the front face may be opaque with or without graphics and/or text printed thereon.

In other embodiments, the front face 12 is non-rigid and thus is somewhat flexible and susceptible to collapse upon the generation of the vacuum created upon the removal of product from the container volume. This embodiment of a front face 12 will be disclosed with reference to FIGS. 22 and 23. In embodiments having a flexible and collapsible front face, the front face 12 includes a frame 18 extending around at least a portion of the perimeter 56 of the front face 12. The frame 18 includes a plurality of frame supports 58, which in this embodiment are shown in the form of apertures 60*a, b, c, d, e, f, g*. In this embodiment, the frame 18 extends around the entire perimeter 56 of the front face 12, but in accordance with the function the frame 18 and frame supports 58 are to serve, it will be appreciated that this invention may be practiced with a frame defined around at least a portion of the perimeter of the front face. Additionally, while the frame supports 58 are shown as apertures in this embodiment, in accordance with the function the frame supports 58 are to serve, it will be appreciated that this invention may be practiced with frame supports structured in other ways. For example, frame supports might be provided as posts or hooks or hook fabric or loop fabric (as in hook-and-loop fasteners), the posts or hooks or hook/loop fabric interacting with an appropriate complimentary structure on the dispenser, as further discussed below.

Figure 22:
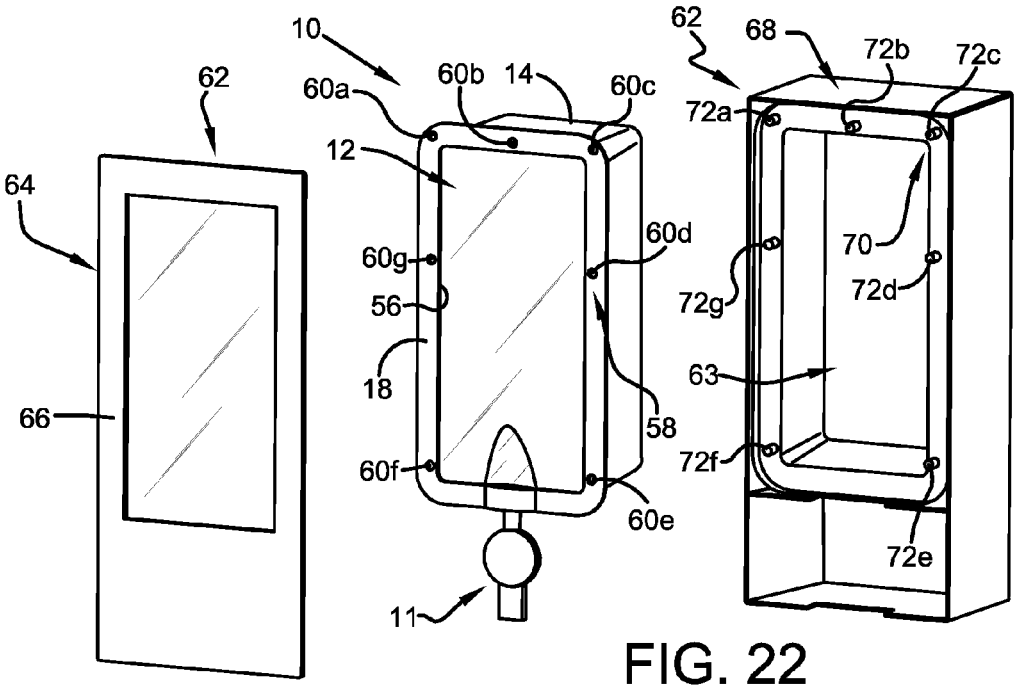
FIG. 22 is a perspective assembly view of a dispenser housing and how it would receive a collapsible container in accordance with this invention.
Figure 23:
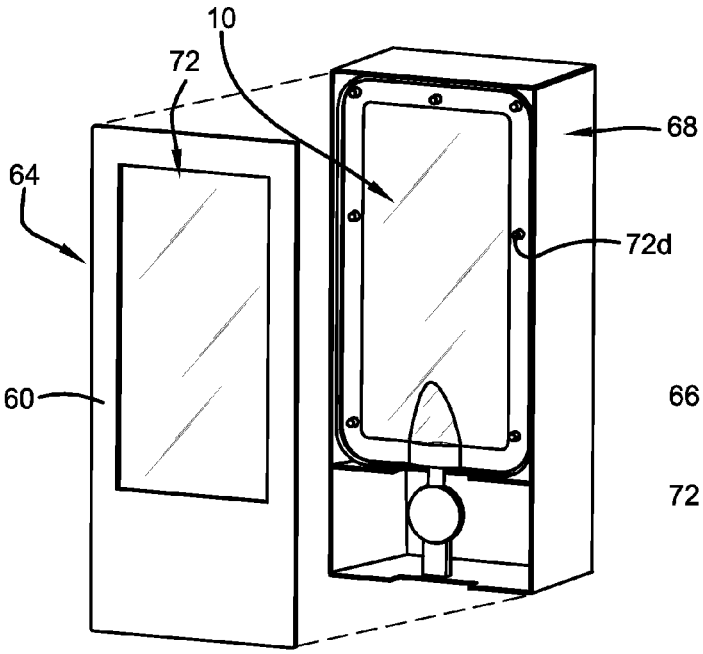
FIG. 23 is a perspective view of the assembly of FIG. 22, shown with the collapsible container received in a portion of the housing.

In the case of a flexible front face 12, the frame supports 58 are employed to retain the shape of the front face 12 when mounted in a dispenser housing. This is shown in FIGS. 22 and 23, wherein a dispenser housing of a wall-mounted type is shown and volume designated by the numeral 62. The dispenser housing 62 defines a volume 63 for receipt of a collapsible container, in this example, a collapsible container 10 having a flexible front face 12, a collapsible backing 14, a frame 18 and a plurality of frame supports 58 in the form of apertures 60*a-g*. A pump 11 is secured to the collapsible container 10 and the actuation of the pump 11 causes a dose of product to be dispensed from the container 10, resulting in the decreasing of the container volume and the collapsing of the collapsible backing 14. A cover 64 providing a front wall 66 is removable secured to a receptacle 68 so that the dispenser housing 62 may be opened to remove an empty collapsible container 10 and replace it will a collapsible container 10 that is full. The cover 64 may instead pivot open on receptacle 68, as generally known. The housing 62 also provides a plurality of tensioning mounts 70 in the form of rods 72*a, b, c, d, e, f, g*, and, as seen in FIG. 23, the frame supports 58, and more particularly the apertures 60*a-g* are fitted over the tensioning mounts 70, more particularly the rods 60*a-g*, when the collapsible container 10 is mounted in the dispenser housing 62, more particularly the receptacle 68. Notably, the flexible front face 12, is kept taut by the tensioning mounts 70 and their interaction with the frame supports 58 such that the front face 12, though flexible, cannot collapse or twist or kink as doses are dispensed. Instead, the collapsible backing 14 collapses toward the front face 12, while the front face 12 retains its original shape due to the tension maintained by the tensioning mounts 70.

It should now be better appreciated why the frame supports can be provided in any number of ways, for example, as posts or hooks or hook fabric or loop fabric (as in hook-and-loop fasteners). Any suitable structure may be used provided that it can engage a structure on the dispenser housing to keep the front face taut. Posts on the frame may interact with holes in the housing, or hooks on the frame may engage eyelets in the housing or hook fabric on the frame may engage loop fabric on the housing (or vice versa).

Figure 24:
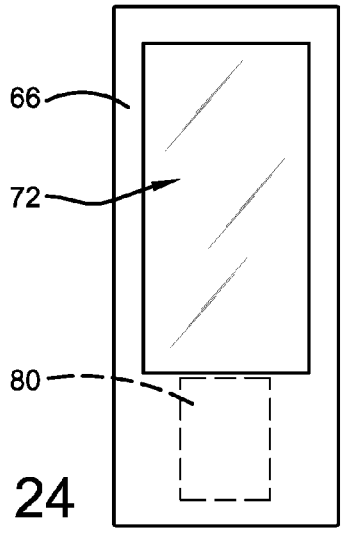
FIG. 24 is a front elevation view of an assembled dispenser of FIGS. 22 and 23.

In some embodiments, the front wall 66 includes a sight window 72 allowing for the viewing of at least a portion of the interior of the housing 62. As seen in FIGS. 22-24, the sight window 72 aligns with at least a portion of the front face 12 such that the front face 12 can be viewed there through. In embodiments wherein the front face 12 is transparent or translucent, the product in the container volume can be viewed through the site window 72. As noted above, the interior surface of the rear wall of the collapsible backing may carry a notice that the container is almost empty or needs to be refilled, and this notice could be viewed through the site window 72. It is common for the site window 72 to actually carry a physical window (i.e., clear plastic to be seen through), but, in some embodiments, particularly where the front face 12 is shape retaining, the sight window 72 may be a simple aperture, devoid of a physical window (i.e., transparent covering), and the front face of the collapsible container can serving as the physical window. In such embodiments, the front face 12 should be formed to be strong enough that it would resist puncturing or other tampering.

As seen in FIG. 24, when the collapsible container 10 of this invention is received in a dispenser housing 62 and a pump is secured to the collapsible container, any number of known or hereafter developed actuation mechanisms may be employed to actuate the pump, the actuation mechanism being generally represented at the numeral 80. The pump would dispense to a hand underneath the housing, as is generally known. Indeed, the pumps and actuation mechanisms of dispenser housings are not the focus of this invention, which is concerned with the disclosure of new collapsible containers. How these containers can be applied in the dispenser arts will be readily apparent to those of ordinary skill in the art.

It should be appreciated that all of the terms respecting the orientation of various walls (front, rear, left, right, top, bottom) are all relative and do not in any way limit the present invention. Indeed, in some embodiments, the collapsible containers may be oriented such that the bottom wall is actually a top wall or even a side wall.

In light of the foregoing, it should be appreciated that the present invention significantly advances the art by providing a collapsible container that is structurally and functionally improved over the prior art in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A collapsible container for receipt in a dispenser housing that provides means for the dispensing of product from the collapsible container, the collapsible container comprising:

a front face formed of a shape-retaining material that resists deformation;

a collapsible backing secured to said front face to define a container volume, wherein said collapsible backing includes fold lines and said collapsible backing collapses along said fold lines as said container volume decreases; and product retained within said container volume, wherein the container volume is sealed such that the removal of a portion of said product from said container volume causes said container volume to decrease, and, as said container volume decreases due to the removal of product, (a) said collapsible backing collapses by vacuum toward said front face and (b) said front face retains its shape due to being formed from said shape-retaining material.

2. The container of claim 1, wherein said front face includes perimeter and a frame defined around at least a portion of said perimeter, and said frame includes a plurality of frame supports.

3. The container of claim 1, wherein said collapsible backing is made of a flexible film.

4. A collapsible container for receipt in a dispenser housing that provides means for the dispensing of product from the collapsible container, the collapsible container comprising:

a front face formed of a shape-retaining material that resists deformation;

a collapsible backing secured to said front face to define a container volume, wherein said collapsible backing includes:

a rear wall opposite said front face;

right and left side walls interconnecting said front face and said rear wall;

a bottom wall interconnecting with said front face, rear wall, right side wall and left side wall;

a top wall interconnecting with said front face, rear wall, right side wall and left side wall, said front face, rear wall, right side wall, left side wall, top wall and bottom wall defining a container volume holding product;

a rear wall upper fold line extending across said rear wall, said rear wall upper fold line separating said rear wall into an upper facet between said rear wall upper fold line and said top wall and a central facet between said rear wall upper fold line and said bottom wall, wherein the removal of product from said container causes said container volume to decrease, and, as said container volume decreases, said container folds along said rear wall upper fold line such that said upper facet folds down toward said central facet and said front wall is devoid of a fold line that mimics the structure and function of said rear wall upper fold line such that the folding at said rear wall upper fold line is not simulated at said front wall and said front wall retains its shape; and product retained within said container volume, wherein the container volume is sealed such that the removal of a portion of said product from said container volume causes said container volume to decrease, and, as said container volume decreases due to the removal of product, (a) said collapsible backing collapses by vacuum toward said front face and (b) said front face retains its shape due to being formed from said shape-retaining material.

5. The container of claim 1, wherein, as additional portions of said product are removed from said container volume and the container approaches the empty configuration, at least a portion of said collapsible backing comes into close proximity to said front face.

6. The container of claim 5, wherein at least a portion of said front face is transparent or translucent.

7. A collapsible container for receipt in a dispenser housing that provides means for the dispensing of product from the collapsible container, the collapsible container comprising:

a front face having a perimeter, wherein at least a portion of said front face is transparent or translucent;

a frame defined around at least a portion of said perimeter of said front face adapted to engage the dispenser housing to retain the front face in position in the housing;

a collapsible backing secured to said front face to define a container volume; and product retained within said container volume, wherein the container volume is sealed such that the removal of a portion of said product from said container volume causes said container volume to decrease, and, as said container volume decreases, said collapsible backing collapses by vacuum toward said front face, and, as additional portions of said product are removed from said container volume and the container approaches an empty configuration, at least a portion of said collapsible backing comes into close proximity to said front face, wherein said collapsible backing has an interior surface, and indicia is provided on said interior surface such that said indicia is visible through said transparent or translucent portion of said front face when said interior surface approaches near or contacts said front face.

8. A dispenser comprising:

a housing defining a volume for receipt of a collapsible container, said housing including;

a front wall having a sight window allowing for viewing of at least a portion of the interior of the housing, and tensioning mounts; and a collapsible container retained within said housing, said container being collapsible from a filled configuration to a substantially empty configuration during dispensing of the contents therein, the container comprising:

a front face having a perimeter, positioned in close proximity to said sight window of said housing, a frame defined around at least a portion of said perimeter of said front face, frame supports in said frame;

a collapsible backing secured to said front face to define a container volume, said collapsible backing including:

a rear wall separated from said front face a top wall, a bottom wall, a left sidewall and a right side wall, wherein said rear wall is opposite said front face, and said left side wall and said right side wall interconnect said front face with said rear wall and interconnect said top wall with the bottom wall, said bottom wall and said top wall each interconnect with said front face, said rear wall, said left side wall and said right side wall, wherein said bottom wall, said top wall, said left side wall and said right side wall are all formed with steps that are weaker than the rear wall; and product retained within said container volume, wherein a dose of product is dispensed from said container volume upon actuation of the dispenser, wherein the container is sealed such that the dispensing of a dose of product from said container volume causes said container volume to decrease, wherein said rear wall is thicker than said bottom wall, said top wall, said left side wall and said right side wall, such that said bottom wall, said top wall, said left side wall and said right side wall are all weaker than said rear wall, and, as said container volume decreases, said bottom wall, said top wall, said left side wall and said right side wall each collapses in on itself, telescoping at said steps, while said rear wall tends to retain its shape and is thus drawn toward the front face, said collapsible backing collapsing by vacuum toward said front face, said front face being held in place by the interaction of said tensioning mounts and said frame supports such that said front face retains its shape and is retained in place as said collapsible backing collapses toward said front face such that said front face remains in close proximity to said sight window.

9. The dispenser of claim 8, wherein said front face includes graphics or text.

10. The dispenser of claim 8, further comprising a pump, said pump being actuated upon actuation of the dispenser, and actuation of said pump dispenses a dose of said product from said container volume.

* * * * *